United States Patent [19]

Hala et al.

[11] 3,964,226

[45] June 22, 1976

[54] ADJUSTABLE WALL-TIE REINFORCING SYSTEM

[75] Inventors: Alfred A. Hala, Islip; Bernard J. Schwalberg, Brooklyn, both of N.Y.

[73] Assignee: Hohmann & Barnard, Inc., Hauppauge, N.Y.

[22] Filed: Sept. 27, 1974

[21] Appl. No.: 510,054

[52] U.S. Cl. ..... 52/562; 52/713

[51] Int. Cl.[2] ..... E04B 2/30

[58] Field of Search ..... 52/712–714, 52/562, 568, 428, 426, 508

[56] References Cited

UNITED STATES PATENTS

| | | | |
|---|---|---|---|
| 3,059,380 | 10/1962 | Holsman | 52/710 |
| 3,277,626 | 10/1966 | Brynjolfsson et al. | 52/713 |
| 3,300,939 | 1/1967 | Brynjolfsson et al. | 52/713 |
| 3,309,828 | 3/1967 | Tribble | 52/713 |
| 3,342,004 | 9/1967 | Lucas | 52/428 |
| 3,377,764 | 4/1968 | Storch | 52/713 |

FOREIGN PATENTS OR APPLICATIONS

| | | | |
|---|---|---|---|
| 575,399 | 5/1959 | Canada | 52/712 |
| 19,949 | 9/1906 | United Kingdom | 52/712 |

*Primary Examiner*—Ernest R. Purser
*Attorney, Agent, or Firm*—Philip D. Amins

[57] ABSTRACT

An adjustable wall-tie reinforcing system for use in conjunction with the construction of wall systems having an inner wythe and an outer wythe, and comprising a reinforcing wall-tie assembly including a pair of spaced parallel reinforcing members disposed within said inner wythe and a plurality of predeterminably spaced laterally extending members. The laterally extending members have the inner ends thereof secured to one of said parallel reinforcing rods and the outer ends thereof disposed in the space between said wythes. The system also includes a wall-tie element comprising a longitudinal rod which has a plurality of predeterminably spaced lateral rods whose inner ends are secured to said longitudinal rod. The wall-tie element is secured in said outer wythe with the outer ends of said spaced lateral rods being disposed in the space between said wythes. These outer ends are adapted to adjustably engage with the outer ends of said laterally extending members within predetermined vertical limits, so as to secure said inner and outer wythes with respect to one another; while preventing inward or outward lateral movement of said wythes with respect to one another.

20 Claims, 8 Drawing Figures

ADJUSTABLE WALL-TIE REINFORCING SYSTEM

BACKGROUND OF THE INVENTION

The present invention pertains to a new and novel adjustable wall-tie reinforcing system for use in conjunction with wall systems employing an inner wythe and an outer wythe and, more particularly, to a wall system which permits for reinforcement of the inner and outer wythes and for adjustment necessitated by misalignment between corresponding courses of the wythes by providing for wall-tie securement between the wythes by employing a wall-tie reinforcing system having vertical adjustability and in some embodiments, horizontal and vertical adjustability.

Although there are presently existing systems which permit adjustability in the securement of inner and outer wythes, these systems normally employ singular elements which render the use thereof both burdensome and costly, due to material and labor costs. Moreover, these systems do not provide for reinforcement of both the inner and outer wythes.

SUMMARY OF THE INVENTION

Accordingly, it is the primary object of the present invention to provide a new and novel wall-tie reinforcing system for use in the construction of wall systems employing an inner wythe and an outer wythe and comprising a wall-tie reinforcing assembly and a wall-tie reinforcing element adapted to be secured to one another and which are vertically adjustable with respect to one another to permit said securement even when corresponding courses of the wythes are positioned in non-vertical alignment.

It is another object of the present invention to provide a wall-tie reinforcing system of the aforesaid type employing a wall-tie reinforcing element of predetermined longitudinal dimension having a plurality of laterally extending rods providing for a plurality of engaging positions of said wall-tie reinforcing element with the wall-tie reinforcing assembly.

It is still another object of the present invention to provide a wall-tie reinforcing system of the foregoing type employing a wall-tie reinforcing element having laterally extended rods which terminate in predetermined hook securing configurations to enable vertically adjustable connection of said wall-tie reinforcing element with said wall-tie reinforcing assembly.

It is yet a further object of the present invention to provide a wall-tie reinforcing system of the foregoing type wherein said wall-tie reinforcing assembly includes means operative in conjunction with said predetermined hook securing configurations to permit both vertical and horizontal adjustment of said wall-tie reinforcing system.

It is a more general object of the present invention to provide a wall-tie reinforcing system which provides for reinforcement of both the inner and outer wythes of the system and permits for adjustability in the wall-tie securement to correct for vertical misalignment between wythes.

BRIEF DESCRIPTION OF THE DRAWINGS

The foregoing and other objects, features and advantages of the present invention will become more apparent from the detailed description hereinafter when considered in conjunction with the accompanying drawings wherein.

DETAILED DESCRIPTION OF THE PREFERRED EMBODIMENTS

Figure 1:
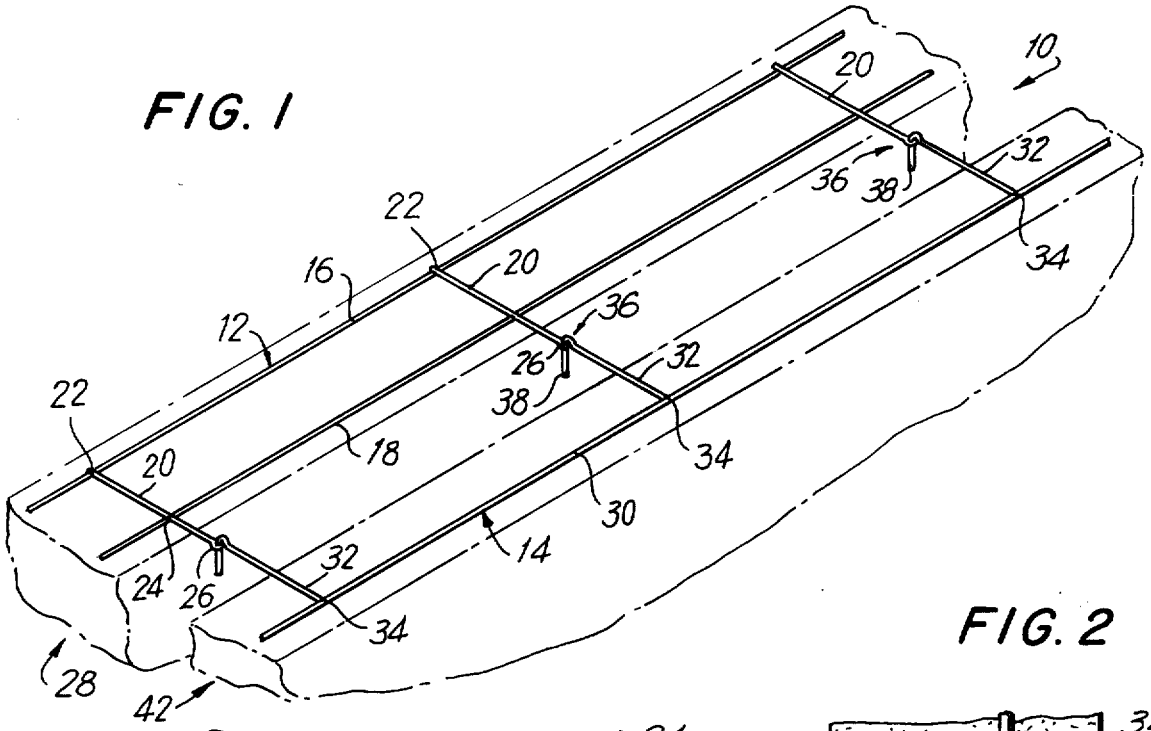
FIG. 1 is a perspective view of a first embodiment of a wall-tie reinforcing system constructed pursuant to the teachings and principles of the present invention.
Figure 2:
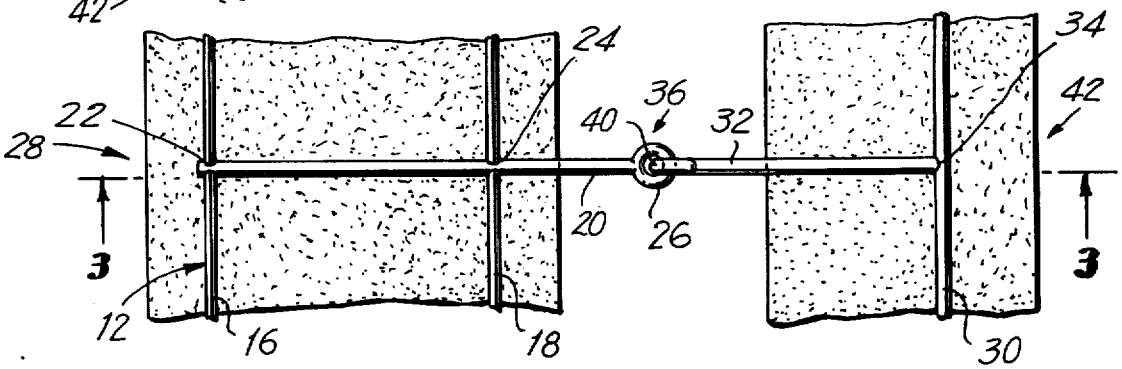
FIG. 2 is a segmented top view of the system depicted in FIG. 1.

Referring now to FIG. 1, there is depicted a wall-tie reinforcing system 10 constructed in accordance with the principles of the present invention and depicting a first embodiment thereof. The system 10 comprises a reinforcing wall-tie assembly, generally denoted by the reference numeral 12, and a longitudinal reinforcing wall-tie element 14. The reinforcing wall-tie assembly 12 comprises a pair of spaced parallel longitudinally extending reinforcing members 16 and 18 and a plurality of equally spaced laterally extending members 20. The members 20 have the inner ends 22 thereof secured to the member 16 and have an intermediate point 24 thereof secured to the other member 18. The outer ends of the laterally extending members 20 are terminated in the form of an eyelet 26. The wall-tie assembly 12 is built into the inner wythe 28 by being placed, and thereafter secured by mortar 29, between successive courses of the inner wythe and serves to reinforce and strengthen the resultant structure.

Figure 3:
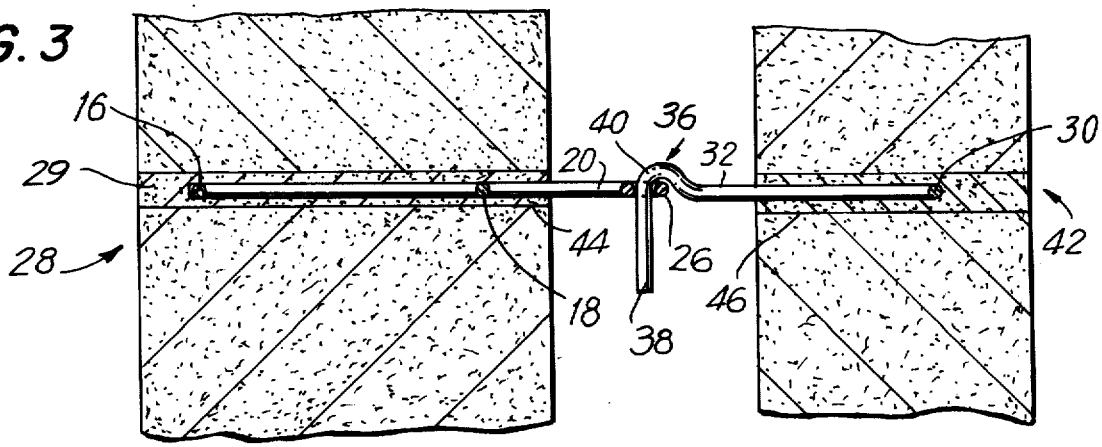
FIG. 3 is a sectional view taken on the line 3—3 of FIG. 2.

The reinforcing wall-tie element 14 comprises a longitudinal rod 30 having a plurality of equally spaced lateral rods 32 secured thereto. In this regard, it is to be noted that the rods 32 have the inner ends 34 thereof secured to the rod 30, while the outer or distal ends 36 of the rods 32 terminate in a downwardly projecting finger 38. The end 36 includes an arcuate portion 40 which is required to provide proper securement between the assembly 12 and the element 14 when the joinder of courses of the inner wythe 28 and the outer wythe 42 are in perfect coplanar relationship, as depicted in FIG. 3. In this regard, when the course 44 of inner wythe 28 is coplanar with course 46 of outer wythe 42, then to secure proper engagement of element 14 to assembly 12, it is necessary that the members 20 be coplanar with rods 32. This is accomplished by the provision of arcuate portion 40 which is then placed in abutting engagement with eyelet 26. Thus, the rods 30 and 32 are disposed in coplanar relationship and are positioned perpendicularly to the plane of the projecting finger 38.

It will, of course, be apparent to those skilled in the art that the element 14 which is built into the outer wythe 42 by positional securement between successive courses thereof, serves to reinforce and strengthen said outer wythe. Thus, the present invention provides a wall system having reinforced inner and outer wythes and wall-tie securement means for preventing any relative movement between said inner and outer wythes. The system 10 can be utilized, as described, only when the courses of the wythes 28 and 42 are coplanar or when the joinder of courses of the wythe 42 are at a raised elevation with respect to the joinder of courses of the wythe 28. In those situations where the joinder of courses of wythe 42 are at a lower elevation than the joinder of courses of the wythe 28, it is necessary to reverse the position of the wall-tie element 14 such that the projecting fingers 28 extend upwardly through the eyelets 26. It will thus be appreciated that the system 10 is one which offers great flexibility and compensation for vertical misalignment. Additionally, it is to be noted that the distance between adjacent members 20 and adjacent rods 32 are equal. In most instances the distance will be sixteen inches; however, any preselected interval is possible.

Figure 4:
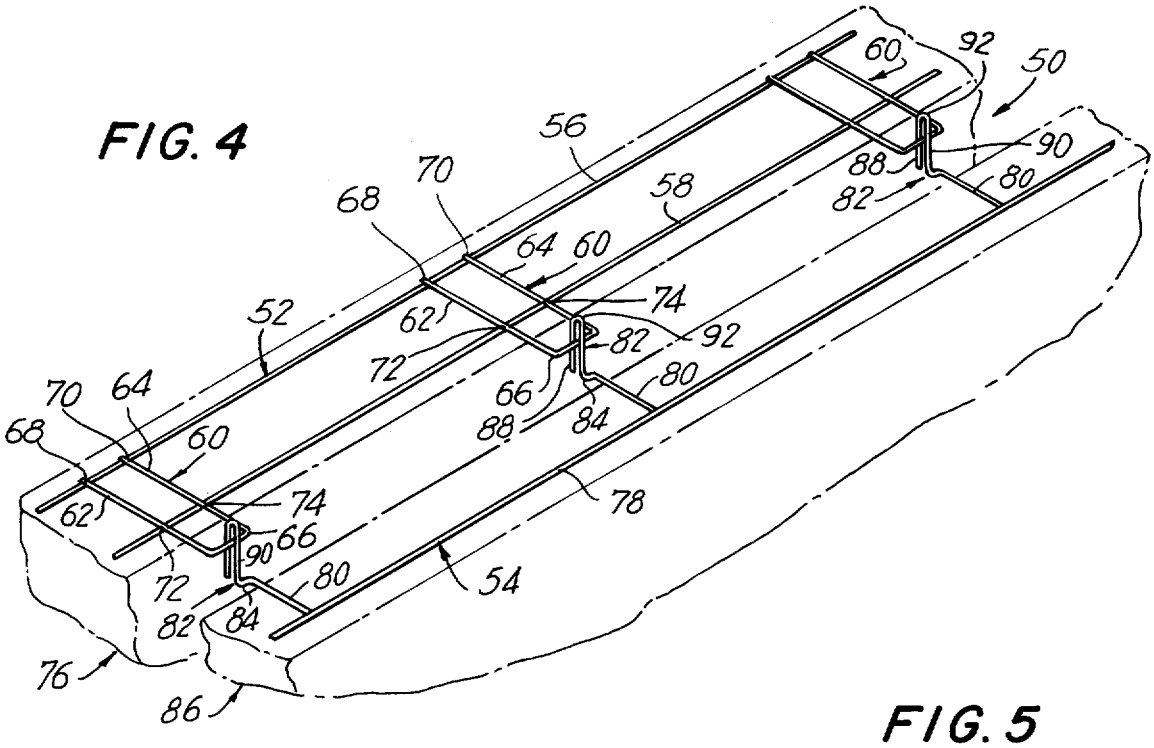
FIG. 4 is a perspective view of a second embodiment of a wall-tie reinforcing system constructed in accordance with the principle of the present invention.
Figure 5:
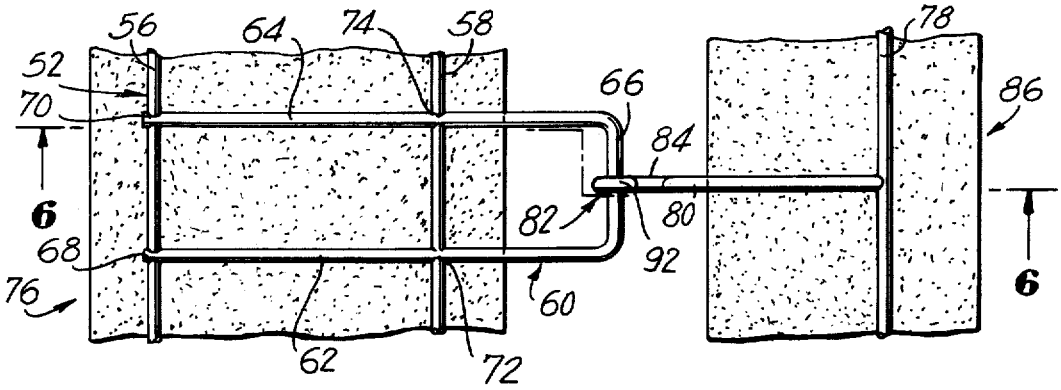
FIG. 5 is a segmented top view of a system depicted in FIG. 4.
Figure 6:
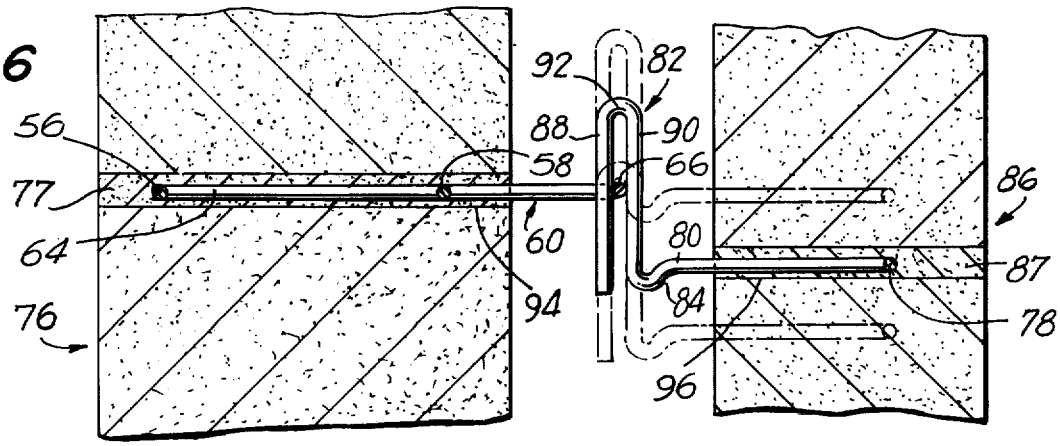
FIG. 6 is a sectional view taken on the line 6—6 of FIG. 5 and clearly depicting the vertical adjustability of the system.

A second The of the present invention is depicted in FIGS. 4 through 6. In this embodiment, there is depicted a wall-tie reinforcing system gnerally denoted by the reference numeral 50. The system 50 comprises a reinforcing wall-tie assembly 52 and a longitudinal reinforcing wall-tie element 54. the reinforcing wall-tie assembly 52 comprises a pair of spaced parallel longitudinally extending reinforcing members 56 and 58 and a plurality of equally spaced laterally extending U-shaped members 60. The members 60 comprise arms 62, 64 and base portion 66. The inner ends 68 and 70 of the arms 62 and 64, respectively, are secured to the member 56, while intermediate portions of the arms 62 and 64 are secured to the member 58 at 72 and 74, respectively. The members 60 are preferably secured to the members 56 and 58, as aforedescribed, by welding. The wall-tie assembly 52 is built into and serves to reinforce the inner wythe 76 by being positionally secured between successive courses of said inner wythe, by use of mortar as at 77.

The reinforcing wall-tie element 54 comprises a longitudinal rod 78 having a plurality of equally spaced lateral rods 80 secured thereto. The lateral rods 80 have the inner ends 82 thereof secured to the rod 78, such as by welding. The outer ends of the lateral rods 80 are terminated in a U-shaped end portion 82, extending upwardly therefrom. Disposed between the end portion 82 and the rod 80 is a downwardly extending protuberance 84 which serves as a drip member which assists in directing any water appearing in the space between the inner wythe 76 and the outer wythe 86, downwardly in said space and away from the inner wythe 76. The protuberance 84 also permits for coplanar disposition of the assembly 52 and the element 54.

The U-shaped end portion 82 includes arms 88 and 90 and an arcuate base 92. The space between arms 88 and 90 is just slightly greater than the thickness of the base 66 of the U-shaped member 60, the purpose of which will be explained in detail hereinafter.

The wall-tie element 54 is positionally secured between successive courses of the outer wythe 86, by means of mortar 87, and serves to strengthen and reinforce said wythe. When it is desired to secure the wythe 86 to wythe 76, and the course 94 of inner wythe 76 is at a raised elevation with respect to the course 96 of the outer wythe (as depicted in FIG. 6), the upwardly extending end portion 82 is able to be placed or fitted upon the base 66, to thereby tie assembly 52 with element 54. As described hereinbefore, the space between arms 88 and 90 is just slightly larger than the thickness of base 66 enabling the end portion 82 to securely engage base 66 and to effectuate a laterally immovable ocking engagement therebetween.

In the event the joinder of courses of said inner and outer wythes are coplanar, the engagement will be as above described. However, if the joinder of courses of said outer wythe 86 is at a raised elevation with respect to the joinder of courses of said inner wythe 76, then to obtain the proper securement of end portion 82 with base 66, it is necessary to turn the entire element 54 upside down. In this position, the end portion 82 would extend downwardly of said lateral rod 80 but the immovable locking engagement would occur, as previously. Thus, the laterally immovable locking engagement of assembly 52 with element 54 prevents any lateral movement of the inner wythe 76 with respect to the outer wythe 86.

The system 50 also provides for horizontal adjustability by virtue of the fact that the end portion 82 is capable of horizontal movement along the length of the base 66 of the U-shaped member 60. Thus, if it is required to horizontally offset element 54 with respect to assembly 52 the same can simply and easily be accomplished during the construction of the outer wythe 86. It will therefore be appreciated that the system 50 is one which provides for reinforced inner and outer wythes and wherein there is provided both vertical and horizontal adjustability in the securement of said wythes with respect to one another.

Figure 7:
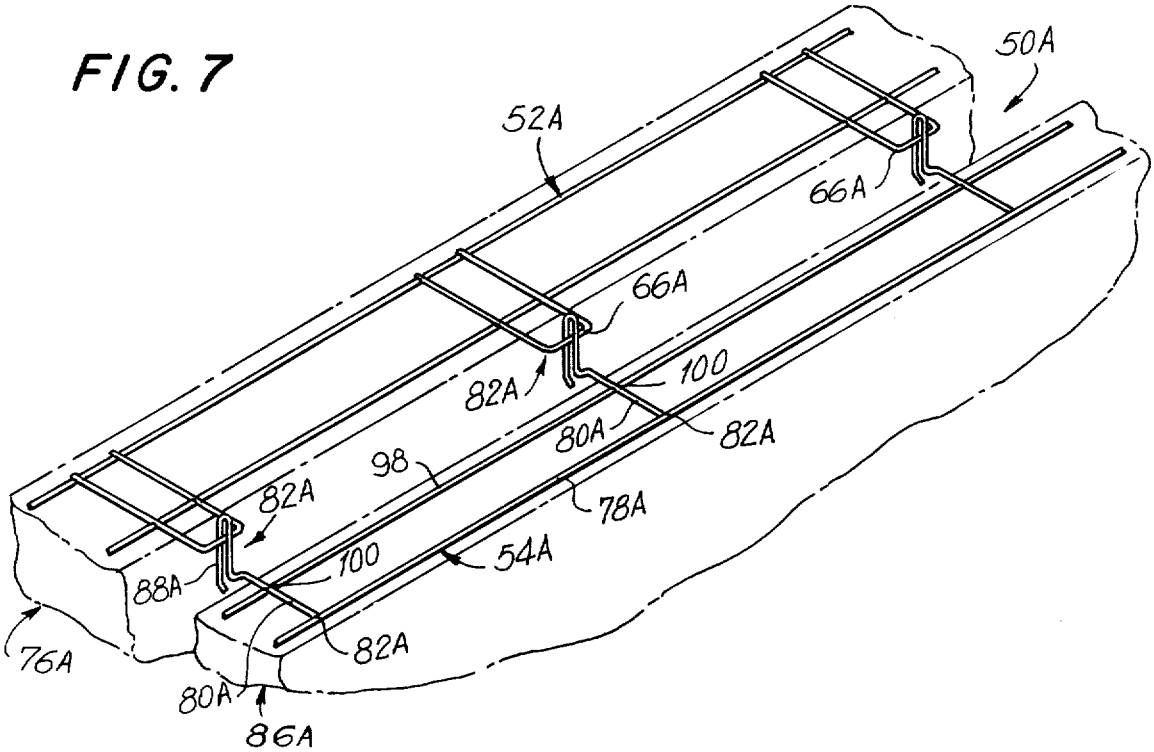
FIG. 7 is a perspective view of a third embodiment of the wall-tie reinforcing system of the present invention.

With reference now to FIG. 7, there is depicted another embodiment of the present invention, similar to that of FIGS. 4 through 6, and wherein similar parts are denoted by similar reference numerals. The system 50A comprises the reinforced wall-tie assembly 52A and a reinforcing wall-tie element 54A. The element 54A comprises a pair of longitudinal rods 78A and 98. The lateral rods 80A are terminated in U-shaped end portions 82A. The inner ends 82A of rods 80A are secured to the rods 78A while intermediate points 100 of the rods 80A are secured to the longitudinal rod 98. Thus, the system 50A is similar to system 50 but provides for additional reinforcement of the outer wythe due to the provision of the additional reinforcing longitudinal rod 98.

Figure 8:
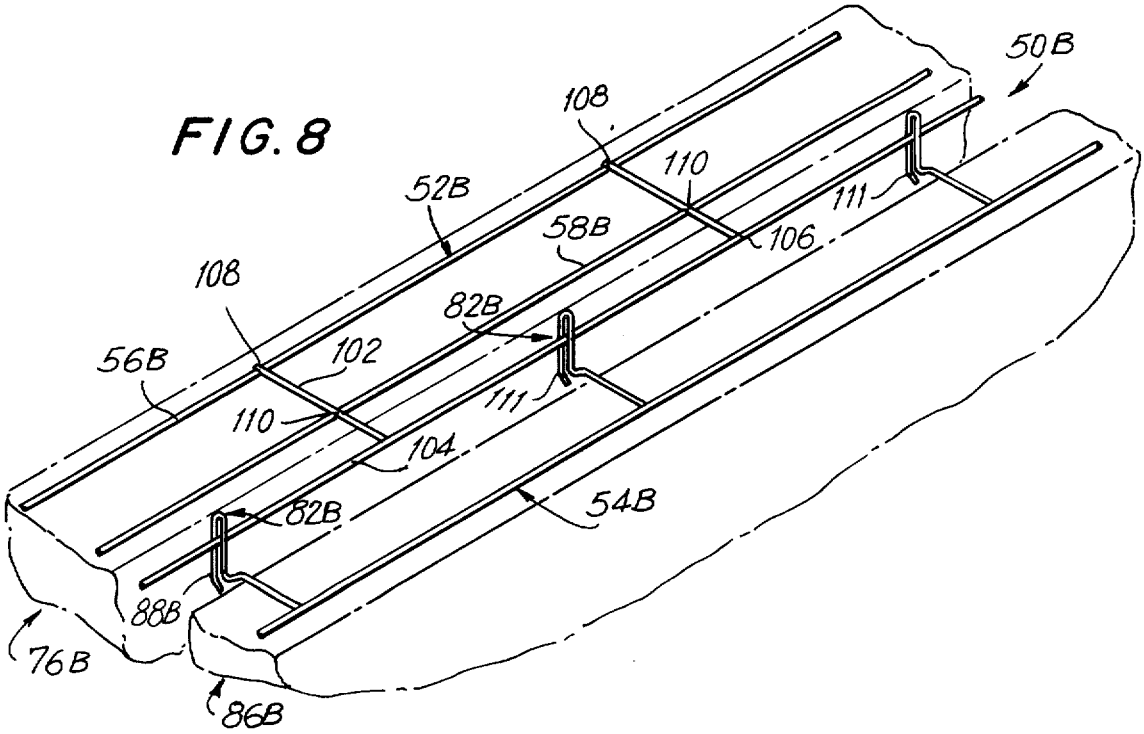
FIG. 8 is a perspective view of a fourth embodiment of the wall-tie reinforcing system of the present invention.

Another embodiment of the present invention is depicted in FIG. 8, wherein similar parts are denoted by similar reference numerals. In this embodiment, the system 50B comprises the reinforcing wall-tie assembly 52B and the reinforcing wall-tie element 54B.

The assembly 52B includes the parallel reinforcing members 56B and 58B and a plurality of equally spaced laterally extending members 102. A third longitudinal member 104, disposed in parallel relationship to member 56B and 58B, is secured to the outer ends 106 of the lateral members 102. The inner ends 108 of lateral members 102 are secured to member 56B, while intermediate points 110 are secured to the member 58B. The member 104 is disposed in the space between the inner wythe 76B and the outer wythe 86B. The U-shaped end portions 82B are adapted to engage the member 104 in laterally immovable locking engagement. However, the engagement is one which provides for both limited vertical adjustability and extensive horizontal adjustability due to the fact that the end portions 82B are free to horizontally slide along the entire portion of the rod disposed between adjacent ones of the lateral members 102.

It is to be noted that in both the embodiments depicted in FIGS. 7 and 8, the U-shaped end portions 82A and 82B, respectively, and more particularly the free arms 88A and 88B, are provided with a projecting member or tip 111 which tip extends rearwardly towards the lateral rods 80A and 80B, respectively. The tips 111 serve to facilitate the initial securement of the wall-tie reinforcing element to the wall-tie reinforcing assembly. This is accomplished by the ease of which the tip 111 engages the base 66A (FIG. 7) or the member 104 (FIG. 8); thereafter, the end portions 82A and 82B can be pushed down upon base 66A or member 104 securing the same within the space between the arms of the U-shaped end portions.

It is thus seen that we have provided a new adjustable reinforcing system for use in the fabrication of wall systems employing inner and outer wythe construction and wherein there is provided both vertical and horizontal adjustability to compensate for variation in the respective courses of said wythes and for construction problems encountered in said fabrication.

While we have shown and described various preferred embodiments of our invention, it will be apparent to those skilled in the art that there are various modifications, changes and improvements which may be made therein without departing from the spirit and scope of the invention as exemplified in the present teachings.

What is claimed is:

1. A wall-tie reinforcing apparatus for use in the construction of wall structures having spaced inner and outer wythes and comprising a wall-tie reinforcing assembly, and a wall-tie reinforcing element, means securing said wall-tie reinforcing assembly with respect to one of said inner and outer wythes, means securing said wall-tie reinforcing element with respect to the other of said inner and outer wythes, said wall-tie reinforcing assembly having a substantially planar construction and comprising a pair of spaced parallel reinforcing members positionally secured within said one of said wythes, and a plurality of U-shaped members extending laterally of said pair of parallel reinforcing members, each of said U-shaped members having a pair of arms and a base, each of said arms being secured to each of said reinforcing members, the base of each of said laterally extending U-shaped members comprising the outer ends thereof and being disposed in the space between said wythes, said wall-tie reinforcing element comprising at least one longitudinal reinforcing rod positionally secured within said other of said wythes, and a plurality of rods extending laterally from said longitudinal reinforcing rod, means securing the inner end of each of said lateral rods to said longitudinal reinforcing rod, the outer end of each of said lateral rods being disposed in the space between said wythes, said base of each of said laterally extending U-shaped members comprising locking means, said outer end of each of said lateral rods having engaging means thereat, said engaging means being vertically adjustable with respect to said base locking means and disposed in locking engagement therewith, and said locking engagement of the outer ends of respective ones of said laterally extending members with respective ones of the outer ends of said lateral rods providing laterally immovable locking engagement of said wall-tie reinforcing element with respect to said wall-tie reinforcing assembly.

2. A wall-tie reinforcing apparatus in accordance with claim 1, wherein said engaging means comprises U-shaped projecting fingers disposed perpendicularly with respect to said lateral rods, and said U-shaped projecting fingers engaging said base in laterally immovable locking engagement.

3. A wall-tie reinforcing apparatus in accordance with claim 2, wherein the center to center distance of said U-shaped members are substantially equal, said lateral rods are equally spaced from one another, and said center to center distance of said U-shaped member is substantially equal to the spacing between adjacent ones of said lateral rods.

4. A wall-tie reinforcing apparatus in accordance with claim 2, wherein said U-shaped projecting fingers are vertically movable with respect to said base and horizontally slidable along the length of said base.

5. A wall-tie reinforcing apparatus in accordance with claim 4, wherein said wall-tie reinforcement element comprises a pair of sapced parallel longitudinal reinforcing rods, and means securing an intermediate point of said lateral rods to the second one of said last mentioned spaced parallel longitudinal reinforcing rods.

6. A wall-tie reinforcing apparatus in accordance with claim 5, wherein the center to center distance of said U-shaped members are substantially equal, said lateral rods are equally spaced from one another, and said center to center distance of said U-shaped members is substantially equal to the spacing between adjacent ones of said lateral rods.

7. A wall-tie reinforcing apparatus for use in the construction of wall structures having spaced inner and outer wythes and comprising a wall-tie reinforcing assembly, and a wall-tie reinforcing element, means securing said wall-tie reinforcing assembly with respect to one of said inner and outer wythes, means securing said wall-tie reinforcing element with respect to the other of said inner and outer wythes.

said wall-tie reinforcing assembly having a substantially planar construction and comprising a pair of spaced parallel reinforcing members positionally secured within said one of said wythes, a plurality of members extending laterally of said pair of parallel reinforcing members, and a third member disposed in parallel relationship with respect to said pair of reinforcing members, means securing each of said laterally extending members to said pair of reinforcing members, means securing said third member to the outer end of each of said lateral members thereby fixedly positioning said third member in the space between said inner and outer wythes, said wall-tie reinforcing element comprising at least one longitudinal reinforcing rod positionally secured within said other of said wythes, and a plurality of rods extending laterally from said longitudinal reinforcing rod, means securing the inner end of each of said lateral rods to said longitudinal reinforcing rod, the outer end of each of said lateral rods being disposed in the space between said wythes, said third member comprising locking means, said outer end of each of said lateral rods having engaging means thereat, said engaging means being vertically adjustable with respect to said locking means and disposed in locking engagement therewith, and said locking engagement of said third member with the outer ends of said lateral rods providing laterally immovable locking engagement of said wall-tie reinforcing element with respect to said wall-tie reinforcing assembly.

8. A wall-tie reinforcing apparatus in accordance with claim 7, wherein said engaging means comprises U-shaped projecting fingers disposed perpendicularly with respect to said lateral rods, and said U-shaped projecting fingers engaging said third member in laterally immovable locking engagement.

9. A wall-tie reinforcing apparatus in accordance with claim 8, wherein said laterally extending members of said wall-tie reinforcing assembly are equally spaced from one another, said lateral rods of said wall-tie reinforcing element are equally spaced from one another, and said space between said lateral members and said lateral rods are equal.

10. A wall-tie reinforcing apparatus in accordance with claim 9, wherein said U-shaped projecting fingers are vertically movable with respect to said third member and horizontally slidable along said third member within the confines of the spacing between adjacent ones of said lateral members.

11. A wall-tie reinforcing apparatus for use in construction of wall structures having spaced inner and outer wythes and comprising a substantially planar wall-tie reinforcing assembly, and a wall-tie reinforcing element, means securing said wall-tie reinforcing assembly with respect to one of said inner and outer wythes, means securing said wall-tie reinforcing element with respect to the other of said inner and outer wythes, said wall-tie reinforcing assembly comprising a pair of spaced parallel reinforcing members positionally secured within said one of said wythes, and a plurality of members extending laterally of said pair of parallel reinforcing members, means securing the inner ends of each of said laterally extending members to one of said reinforcing members, means securing intermediate points of each of said laterally extending members to the other of said reinforcing members, the outer ends of said laterally extending members being disposed in the space between said wythes, said wall-tie reinforcing element comprising at least one longitudinal reinforcing rod positionally secured within said other of said wythes, and a plurality of rods extending laterally from said longitudinal rod, means securing the inner end of each of said lateral rods to said longitudinal reinforcing rod, the outer end of each of said lateral rods being disposed in the space between said wythes, each of said laterally extending members having a U-shaped configuration and the base of the U-shaped member comprising the outer end thereof, the outer end of each of said lateral rods terminating in a U-shaped projecting finger disposed substantially perpendicular to said lateral rod, and said U-shaped projecting fingers engaging said bases of said laterally extending members in laterally immovable locking engagement.

12. A wall-tie reinforcing apparatus in accordance with claim 11, wherein said U-shaped projecting finger comprises a pair of arms and a base, one of said arms of each of said projecting fingers being connected to a corresponding one of said lateral rods, the other of said arms being freely disposed with respect to said lateral rod, and said projecting fingers being vertically movable with respect to said base a distance equal to the length of the shortest one of said pair of arms.

13. A wall-tie reinforcing apparatus in accordance with claim 12, wherein said projecting fingers are horizontally slidable along the length of the base of said laterally extending members.

14. A wall-tie reinforcing apparatus system in accordance with claim 11, wherein said U-shaped projecting finger comprises a pair of arms and a base, one of said arms of each of said projecting fingers being connected to a corresponding one of said lateral rods, the other of said arms being longer than said one of said arms and freely disposed with respect to said lateral rod, said freely disposed end of said other arm including a projecting member disposed inwardly toward said one arm, and said projecting member being capable of facilitiating the initial securement of said projecting finger with respect to the base of said lateral member.

15. A wall-tie reinforcing apparatus in accordance with claim 11, wherein said wall-tie reinforcement element comprises a pair of spaced parallel longitudinal reinforcing rods, and means securing an intermediate point of said lateral rods to the second one of said last mentioned spaced parallel longitudinal reinforcing rods.

16. A wall-tie reinforcing apparatus for use in the construction of wall structures having spaced inner and outer wythes and comprising a wall-tie reinforcing assembly, and a wall-tie reinforcing element, means securing said wall-tie reinforcing assembly with respect to one of said inner and outer wythes, means securing said wall-tie reinforcing element with respect to the other of said inner and outer wythes, said wall-tie reinforcing assembly comprising three parallel spaced longitudinally disposed members, means positionally securing the first and second of said spaced parallel members within said one of said wythes and permitting said first and second members to serve as reinforcing members, the third spaced longitudinal member being disposed in the space between said wythes, and a plurality of members extending laterally of said three spaced parallel longitudinal members, means securing said laterally extending members to each of said three parallel spaced longitudinal members, said wall-tie reinforcing element comprising at least one longitudinal reinforcing rod positionally secured within said other of said wythes, and a plurality of rods extending laterally from said longitudinal reinforcing rod, means securing the inner ends of said lateral rods to said longitudinal reinforcing rod, the outer ends of said lateral rods being disposed in the space between said wythes, the outer ends of said lateral rods terminating in U-shaped projecting fingers disposed substantially perpendicular to said lateral rods, and said U-shaped projecting fingers engaging said third longitudinal member in laterally immovable locking engagement.

17. A wall-tie reinforcing apparatus in accordance with claim 16, wherein said U-shaped projecting finger comprises a pair of arms and a base, one of said arms of each of said projecting fingers being connected to a corresponding one of said lateral rods, the other of said arms being freely disposed with respect to said lateral rod, and said projecting fingers being vertically movable with respect to said third longitudinal member of said wall-tie reinforcing assembly a distance equal to the length of the shortest one of said pair of arms.

18. A wall-tie reinforcing apparatus in accordance with claim 17, wherein said projecting fingers are horizontally slidable along the length of said third longitudinal member within the confines of the spacing between adjacent ones of said laterally extending members.

19. A wall-tie reinforcing apparatus in acordance with claim 16, wherein said U-shaped projecting finger comprises a pair of arms and a base, one of said arms of each of said projecting fingers being connected to a corresponding one of said lateral rods, the other of said arms being longer than said one of said arms and freely disposed with respect to said lateral rod, said freely disposed end of said other arm including a projecting member disposed inwardly toward said one arm, and said projecting member being capable of facilitating the initial securement of said projecting finger with respect to the base of said lateral member.

20. A wall-tie reinforcing apparatus in accordance with claim 16, wherein said wall-tie reinforcement element comprises a pair of spaced parallel longitudinal reinforcing rods, and means for securing an intermediate point of said lateral rods to the second one of said last mentioned spaced parallel longtitudinal reinforcing rods.

* * * * *